US009441475B2

(12) United States Patent
Garnier et al.

(10) Patent No.: US 9,441,475 B2
(45) Date of Patent: Sep. 13, 2016

(54) HEAT DISSIPATION IN DOWNHOLE EQUIPMENT

(71) Applicant: Schlumberger Technology Corporation, Sugar Land, TX (US)

(72) Inventors: Florence Garnier, Briis-sous-Fourges (FR); Jean-Christophe Auchere, Lisses (FR); Alain Guelat, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 883 days.

(21) Appl. No.: 13/682,697

(22) Filed: Nov. 20, 2012

(65) Prior Publication Data

US 2013/0126171 A1 May 23, 2013

(30) Foreign Application Priority Data

Nov. 21, 2011 (EP) ..... 11290551

(51) Int. Cl.
*E21B 36/00* (2006.01)
*E21B 47/01* (2012.01)

(52) U.S. Cl.
CPC ..... *E21B 47/011* (2013.01); *E21B 36/001* (2013.01)

(58) Field of Classification Search
CPC ..... E21B 43/24; E21B 36/001; E21B 47/011
See application file for complete search history.

(56) References Cited

U.S. PATENT DOCUMENTS

| | | | | |
|---|---|---|---|---|
| 4,400,858 | A * | 8/1983 | Goiffon et al. | 24/546 |
| 4,407,136 | A * | 10/1983 | de Kanter | 62/64 |
| 7,246,940 | B2 | 7/2007 | Storm et al. | |
| 2004/0112601 | A1* | 6/2004 | Hache | 166/302 |
| 2006/0101831 | A1 | 5/2006 | Storm et al. | |
| 2006/0102353 | A1 | 5/2006 | Storm et al. | |
| 2006/0144619 | A1 | 7/2006 | Storm, Jr. et al. | |
| 2010/0032161 | A1 | 2/2010 | Peter | |
| 2011/0070301 | A1 | 3/2011 | Luber et al. | |
| 2011/0079391 | A1 | 4/2011 | Bedouet et al. | |
| 2011/0203798 | A1 | 8/2011 | Herrera | |
| 2011/0272135 | A1 | 11/2011 | Kaul et al. | |

FOREIGN PATENT DOCUMENTS

| | | |
|---|---|---|
| EP | 1788188 | 5/2007 |
| RU | 20040132534 | 4/2006 |

(Continued)

OTHER PUBLICATIONS

Office Action for the equivalent Eurasian patent application No. 201201450 issued on Mar. 21, 2013.

(Continued)

*Primary Examiner* — Robert E Fuller
*Assistant Examiner* — David Carroll
(74) *Attorney, Agent, or Firm* — Michael Dae

(57) ABSTRACT

A downhole assembly may include a housing having an outer surface and an inner surface, the outer surface adapted for contact with a downhole fluid, the inner surface defining an interior volume. One or more heat producing components may be disposed within the interior volume and in thermal contact with a structural component (e.g., chassis). One or more thermal dissipation members may be disposed within the housing, the one or more thermal dissipation members in thermal contact with the chassis and in thermal contact with the inner surface of the housing.

13 Claims, 7 Drawing Sheets

(56) References Cited

FOREIGN PATENT DOCUMENTS

| | | | |
|---|---|---|---|
| RU | 2349060 | C1 | 3/2009 |
| WO | 2009/002702 | | 12/2008 |

OTHER PUBLICATIONS

Office action from the equivalent Mexican patent application No. MX/a/2012/013176 issued on Jun. 24, 2015.

* cited by examiner

HEAT DISSIPATION IN DOWNHOLE EQUIPMENT

BACKGROUND

The petroleum well is a hostile environment with high pressures and temperatures, fluid compositions and fluid management, and vibrations and other movements, which renders measurement-while-drilling (MWD) and logging-while-drilling (LWD) operations challenging and stresses MWD and LWD equipment. In particular, the equipment used for MWD and LWD operations may include heat-producing components such as various electronics that can be vulnerable to the well's hostile environment, particularly the high temperatures. It is useful to be able to dissipate heat from and otherwise protect the electronics so as to improve their life expectancy and reliability in the petroleum well.

SUMMARY

In some embodiments, a downhole assembly includes a housing, a structural component extending through the housing, and a heat producing component. A thermal dissipation member extends from the structural component and is in thermal contact with both the heat producing component and the housing. At least a portion of thermal energy generated from the heat producing component is dissipated through housing by transferring said thermal energy from the heat producing component to the housing via the thermal dissipation member. The structural component can be in thermal contact with both the heat producing component and the thermal dissipation member such that at least a portion of said thermal energy is transferred from the heat producing component to the thermal dissipation member via the structural component.

In some embodiments, a method of dissipating thermal energy within a downhole assembly while operating the downhole assembly within a well includes transferring at least a portion of thermal energy generated from a heat producing component disposed within an interior of the downhole assembly to a thermal dissipation member also disposed within the interior of the downhole assembly that is in thermal contact with the heat producing component. The thermal energy is then transferred from the thermal dissipation member to a housing of the downhole assembly and from there is further transferred to a downhole fluid (e.g., drilling mud) flowing outside of the downhole assembly.

In some embodiments, a method of dissipating thermal energy within a downhole assembly while operating the downhole assembly within a well includes transferring at least a portion of thermal energy generated from a heat producing component disposed within an interior of the downhole assembly to a housing of the downhole assembly by circulating a thermally conductive fluid within the interior of the downhole assembly. The thermal energy is then transferred from the housing of the downhole assembly to a downhole fluid that is in contact with an outer surface of the housing.

While multiple embodiments with multiple elements are disclosed, still other embodiments and elements of the present disclosure will become apparent to those skilled in the art from the following detailed description, which shows and describes illustrative embodiments of the inventive subject matters. Accordingly, the drawings and detailed description are to be regarded as illustrative in nature and not restrictive.

DETAILED DESCRIPTION

One or more specific embodiments of the present disclosure will be described below including method, apparatus and system embodiments. These described embodiments and their various elements are examples of the presently disclosed techniques. It should be appreciated that in the development of any such actual implementation, as in any engineering or design project, numerous implementation-specific decisions can be made to achieve the developers' specific goals, such as compliance with system-related and business-related constraints, which can vary from one implementation to another. Moreover, it should be appreciated that such a development effort might be time consuming, but would nevertheless be a routine undertaking of design, fabrication, and manufacture for those of ordinary skill having the benefit(s) of this disclosure.

When introducing elements of various embodiments of the present disclosure, the articles "a," "an," and "the" are intended to mean that there are one or more of the elements. The terms "comprising," "including," and "having" are intended to be inclusive and mean that there can be additional elements other than the listed elements. Additionally, it should be understood that references to "one embodiment" or "an embodiment" of the present disclosure are not intended to be interpreted as excluding the existence of additional embodiments that also incorporate the listed elements.

Figure 1:
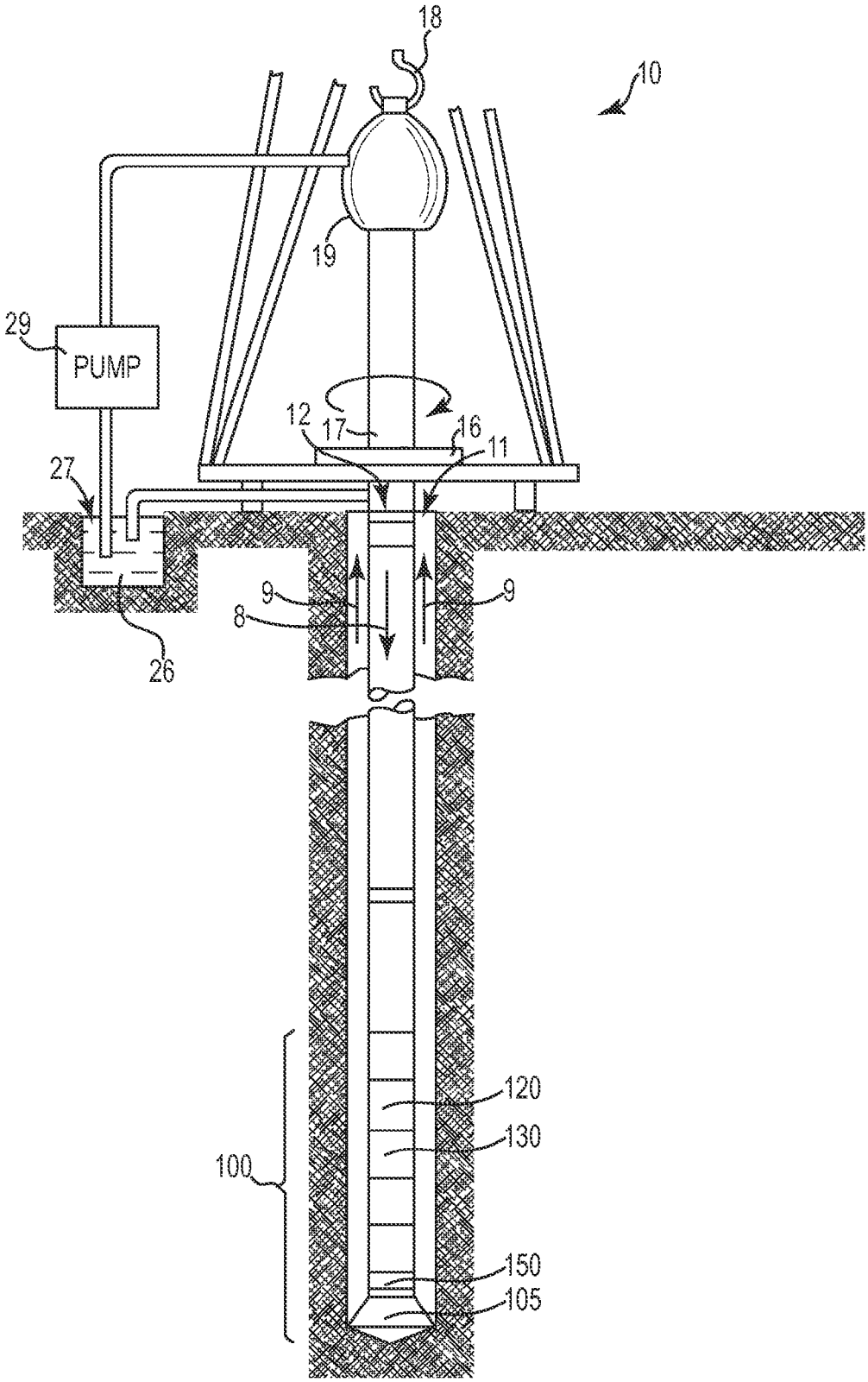
FIG. 1 is a schematic diagram of a wellsite system in accordance with an embodiment of the disclosure.

FIG. 1 illustrates an embodiment of a wellsite apparatus, system and/or methodology. The wellsite system of FIG. 1 can be used to, for example, explore and produce oil, gas, and other resources that can be used, refined, and otherwise processed for fuel, raw materials and other purposes. In the wellsite system of FIG. 1, a borehole 11 can be formed in subsurface formations, such as rock formations, by rotary drilling using any suitable technique. A drillstring 12 can be suspended within the borehole 11 and can have a bottom hole assembly (BHA) 100 that includes a drill bit 105 at its lower end. A surface system of the wellsite system of FIG. 1 can include a platform and derrick assembly 10 positioned over the borehole 11, the platform and derrick assembly 10 including a rotary table 16, a kelly 17, a hook 18 and a rotary swivel 19. The drillstring 12 can be rotated by the rotary table 16, energized by any suitable means, which engages the kelly 17 at the upper end of the drillstring 12. The drillstring 12 can be suspended from the hook 18, attached to a traveling block (not shown), through the kelly 17 and the rotary swivel 19, which permits rotation of the drillstring 12 relative to the hook 18. A topdrive system could alternatively be used, which can be a topdrive system known to those of ordinary skill in the art.

In the wellsite system of FIG. 1, the surface system can also include drilling fluid or mud 26 stored in a pit 27 formed at the well site. A pump 29 can deliver the drilling fluid 26 to the interior of the drillstring 12 via a port in the swivel 19, causing the drilling fluid to flow downwardly through the drillstring 12 as indicated by the directional arrow 8. The drilling fluid 26 can exit the drillstring 12 via ports in the drill bit 105, and circulate upwardly through the annulus region between the outside of the drillstring 12 and the wall of the borehole 11, as indicated by the directional arrows 9. In this manner, the drilling fluid 26 can lubricate the drill bit 105 and carry formation cuttings up to the surface, as the fluid 26 is returned to the pit 27 for recirculation.

The bottom hole assembly (BHA) 100 of the wellsite system of FIG. 1 can, as one example, include one or more of a logging-while-drilling (LWD) module 120, a measuring-while-drilling (MWD) module 130, a roto-steerable system and motor 150, and the drill bit 105. As will be discussed with respect to subsequent Figures, it will be appreciated that downhole equipment such as a MWD module and/or a LWD module can include a variety of heat producing components where dissipation of heat produced by such components can be beneficial.

As shown in FIG. 1, the wellsite system is used for a logging-while-drilling (LWD) or measurement-while-drilling (MWD) operation performed on a land based rig, but could be any type of oil/gas operations (e.g., wireline, coiled tubing, testing, completions, production, etc.) performed on a land based rig or offshore platform.

Figure 2:
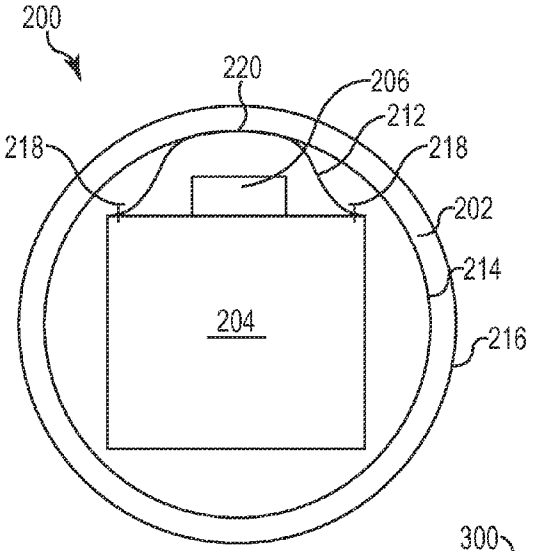
FIG. 2 is a schematic cross-sectional illustration of a portion of a downhole apparatus in accordance with an embodiment of the disclosure.

FIG. 2 is a schematic cross-sectional illustration of a portion of a downhole apparatus 200 that may, for example, be a MWD device or a LWD device. The downhole apparatus 200 includes a housing 202 having an inner surface 214 and an outer surface 216. In some embodiments, the outer surface 216 can be adapted to be in contact with a downhole fluid (e.g., drilling fluid 26 of FIG. 1). A structural component 204 extends through the housing 202. In some embodiments, the structural component 204 can serve as a mounting location for one or more heat producing components 206. The one or more heat producing components 206 are in thermal contact with the structural component 204, meaning that thermal energy produced from the one or more heat producing components 206 may flow into the structural component 204.

The heat producing components 206 can be packaged electronic components such as multi-chip modules (MCMs). In some embodiments, the heat producing components 206 may include individual electronic parts such as IC chips that are soldered or otherwise secured to a substrate such as a silicone-on-insulator (SOI) or a printed circuit board. In some embodiments, metal wiring connections between the heat producing components 206 and the substrate and/or metal wiring traces disposed about the substrate (e.g., copper wiring traces within the printed circuit board) may assist in carrying thermal energy away from the IC chips and other elements within the heat producing components 206.

The downhole apparatus 200 may include one or more thermal dissipation members 212 that are in thermal contact with the structural component 204, meaning that thermal energy that has been transferred into the structural component 204 may flow into the one or more thermal dissipation members 212. While FIG. 2 shows a single heat producing component 206 and a single thermal dissipation member 212, it will be appreciated that in some embodiments the downhole apparatus 200 may include a number of heat producing components 206 and/or a number of thermal dissipation members 212. The thermal dissipation member 212 may be formed of any suitable material. In some embodiments, the thermal dissipation member 212 may be formed from or otherwise include metals such as copper. In some embodiments, the thermal dissipation member 212 may be formed from or otherwise include pyrolytic graphite.

In some embodiments, the heat producing components 206 can be secured directly or indirectly to the thermal dissipation members 212 to enable heat transfer away from the components 206. As illustrated in FIG. 2, the heat producing component 206 and the thermal dissipation member 212 are each secured to the structural component 204 but do not directly contact each other. The heat producing component 206 may be secured to the structural component 204 using any desired technique or attachment method. In some embodiments, the thermal dissipation member(s) 212 may be secured to the structural component 204 using fasteners 218 such as screws, bolts, rivets, spot welds and the like.

Thermal energy produced from the one or more heat producing components 206 may be dissipated through the one or more thermal dissipation members 212. In some embodiments, the one or more thermal dissipation members 212 can be configured to provide one or more physical contact points and/or surfaces between the one or more thermal dissipation members 212 and the inner surface 214 of the housing 202. In some embodiments, the one or more thermal dissipation members 212 may be configured to provide a largely continuous physical contact surface or an intermittent physical contact surface.

In the illustrated embodiment of FIG. 2, the thermal dissipation member 212 has a curved portion 220 that substantially matches a curvature of the inner surface 214 and is in substantial physical contact with the housing 202. Physical contact between the thermal dissipation member 212 and the housing 202 can provide for direct transfer/conduction of thermal energy from the thermal dissipation member 212 to the housing 202. In some embodiments, a thermally conductive gas may flow among the heat producing component 206, the thermal dissipation member 212 and the inner surface 214 of the housing 202, providing for indirect transfer/conduction of thermal energy. Examples of suitable gases include air, inert gases and nitrogen that may be pressurized.

Once thermal energy has been transferred away from the heat producing component 206, through the thermal dissipation member 212 and to the inner surface 214 of the housing 202, the thermal energy can then be further transferred through the housing 202 to the outer surface 216 of the housing 202. From there, the thermal energy can be transferred into the downhole fluid (e.g., drilling fluid 26 of FIG. 1), as the downhole fluid can be at a reduced temperature relative to the downhole environment in general and relative to the interior of the housing 202 in particular.

Figure 3:
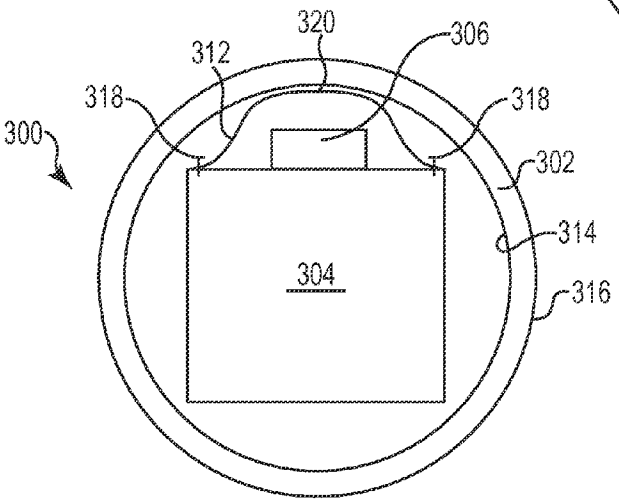
FIG. 3 is a schematic cross-sectional illustration of a portion of a downhole apparatus in accordance with an embodiment of the disclosure.

FIG. 3 is a schematic cross-sectional illustration of a portion of a downhole apparatus 300 that may, for example, be a MWD device or a LWD device. The downhole apparatus 300 includes a housing 302 having an inner surface 314 and an outer surface 316 that is adapted to be in contact with a downhole fluid (e.g., drilling fluid 26 of FIG. 1). A structural component 304 extends through the housing 302 and may serve as a mounting location for one or more heat producing components 306. The one or more heat producing components 306 are in thermal contact with the structural component 304. The heat producing components 306 may be packaged electronic components such as the multi-chip modules (MCMs) discussed with respect to the heat producing components 206 shown in FIG. 2.

The downhole apparatus 300 may include one or more thermal dissipation members 312 that are in thermal contact with the structural component 304. While FIG. 3 shows a single heat producing component 306 and a single thermal dissipation member 312, it will be appreciated that in some embodiments the downhole apparatus 300 may include a number of heat producing components 306 and/or a number of thermal dissipation members 312.

As illustrated in FIG. 3, the heat producing component 306 and the thermal dissipation member 312 are each secured to the structural component 304 but do not directly contact each other. The heat producing component 306 may be secured to the structural component 304 using any desired technique or attachment method. In some embodiments, the thermal dissipation member 312 may be secured to the structural component 304 using fasteners 318 such as screws, bolts, rivets, spot welds and the like.

In the illustrated embodiment of FIG. 3, the thermal dissipation member 312 has a curved portion 320 that substantially matches a curvature of the inner surface 314, but is slightly spaced apart from the inner surface 314. In some embodiments, the close spacing (e.g., a few millimeters or less) between the thermal dissipation member 312 and the inner surface 314 can permit thermal energy to pass into the housing 302 but also help to reduce the transfer of vibrations, shocks and the like from the housing 302 to the structural component 304. In some embodiments, a thermally conductive gas may flow among the heat producing component 306, the thermal dissipation member 312 and the inner surface 314 of the housing 302.

Figure 4:
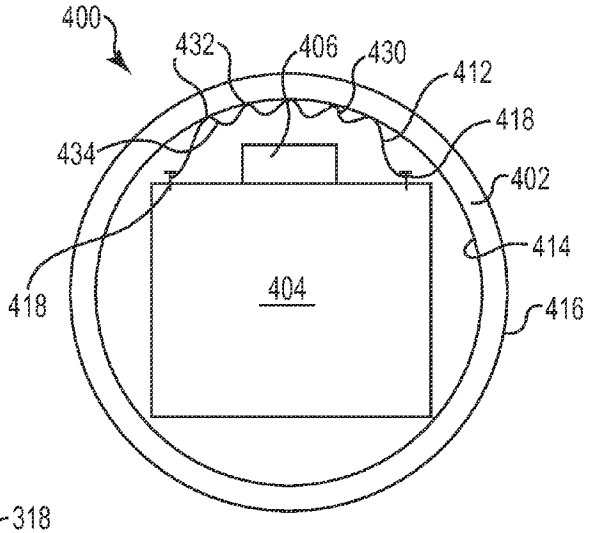
FIG. 4 is a schematic cross-sectional illustration of a portion of a downhole apparatus in accordance with an embodiment of the disclosure.

FIG. 4 is a schematic cross-sectional illustration of a portion of a downhole apparatus 400 that includes a housing 402 having an inner surface 414 and an outer surface 416 that is adapted to be in contact with a downhole fluid (e.g., drilling fluid 26 of FIG. 1). A structural component 404 extends through the housing 402 and may serve as a mounting location for one or more heat producing components 406. The one or more heat producing components 406 are in thermal contact with the structural component 404. The heat producing components 406 may include packaged electronic components such as the multi-chip modules (MCMs) discussed with respect to the heat producing components 206 shown in FIG. 2.

The downhole apparatus 400 may include one or more thermal dissipation members 412 that are in thermal contact with the structural component 404. While FIG. 4 shows a single heat producing component 406 and a single thermal dissipation member 412, it will be appreciated that in some embodiments the downhole apparatus 400 may include a number of heat producing components 406 and/or a number of thermal dissipation members 412.

As illustrated in FIG. 4, the heat producing component 406 and the thermal dissipation member 412 are each secured to the structural component 404 but do not directly contact each other. The heat producing component 406 may be secured to the structural component 404 using any desired technique or attachment method. In some embodiments, the thermal dissipation member 412 may be secured to the structural component 404 using fasteners 418 such as screws, bolts, rivets, spot welds and the like.

In the illustrated embodiment of FIG. 4, the thermal dissipation member 412 has an undulating portion 430 that includes alternating peaks 432 and troughs 434. The peaks 432 physically contact the inner surface 414 of the housing 402 to provide direct thermal conduction while the troughs 434 provide indirect thermal conduction (and reduce vibrations/shocks). In some embodiment, the peaks 432 may be slightly spaced apart from the inner surface 414 to further limit shocks/vibrations that could otherwise be transferred from the housing 402 to the structural component 404. In some embodiments, a thermally conductive fluid may flow through the troughs 434 to improve thermal transfer/conduction.

Figure 5:
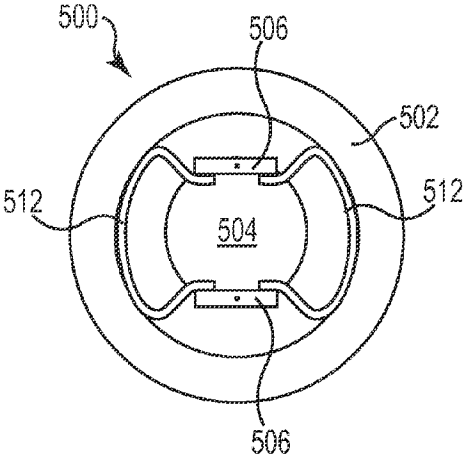
FIG. 5 is a schematic cross-sectional illustration of a portion of a downhole apparatus in accordance with an embodiment of the disclosure.

FIG. 5 is a schematic cross-sectional illustration of a portion of a downhole apparatus 500 that includes a housing 502. A pair of heat producing components 506 are in thermal contact with a structural component 504. A pair of thermal dissipation members 512 are in thermal contact with the structural component 504. As illustrated, the heat producing components 506 are in substantial physical contact with the structural component 504 and with the thermal dissipation members 512. In this embodiment, the thermal dissipation members 512 may be seen as making substantial physical contact with the housing 502 and thus provide direct thermal transfer/conduction therebetween. In some embodiments, the thermal dissipation members 512 may be slightly spaced apart from the housing 502 to reduce vibrations, shocks and the like that may be transferred from the housing 502 to the structural component 504 and/or the heating producing components 506. A thermally conductive fluid may circulate through the housing 502, if desired.

Figure 6:
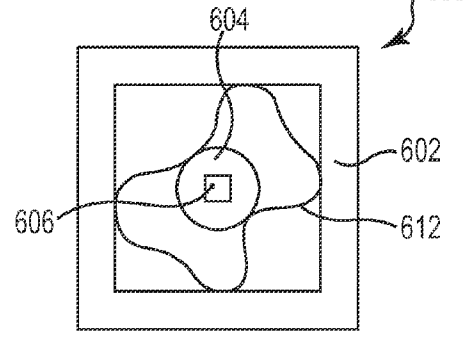
FIG. 6 is a schematic cross-sectional illustration of a portion of a downhole apparatus in accordance with an embodiment of the disclosure.

FIG. 6 is a schematic cross-sectional illustration of a portion of a downhole apparatus 600 that includes a housing 602. As illustrated, the housing 602 is shown as being square in cross-section, although other profiles are contemplated. A heat producing component 606 is in thermal contact with a structural component 604. A thermal dissipation member 612 extends around the structural component 604 and makes intermittent physical contact with the structural component 604 and with the housing 602 for direct thermal transfer/conduction therebetween. In some embodiments, the thermal dissipation member 612 can be slightly spaced apart from the structural component 604 and/or the housing 602 to reduce vibrations and/or shocks that may been transferred from the housing 602 to the structural component 604. This embodiment may provide the thermal dissipation member 612 with a relatively larger thermal mass, meaning that the thermal dissipation member 612 is able to absorb more thermal energy produced from the heat producing component 606. A thermally conductive fluid may circulate through the housing 602, if desired. A relatively large surface area of the thermal dissipation member 612 may aid in thermal transfer to the thermally conductive fluid.

Figure 7:
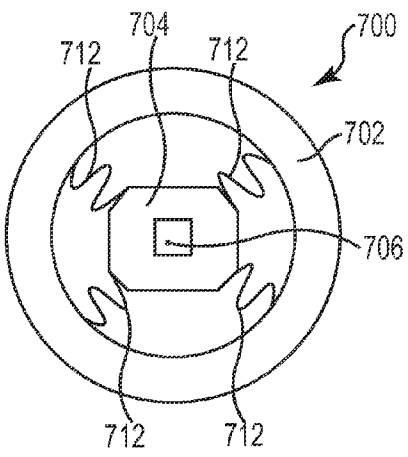
FIG. 7 is a schematic cross-sectional illustration of a portion of a downhole apparatus in accordance with an embodiment of the disclosure.

FIG. 7 is a schematic cross-sectional illustration of a portion of a downhole apparatus 700 that includes a housing 702. A heat producing component 706 is in thermal contact with a structural component 704. Several thermal dissipation members 712 extend between the structural component 704 and the housing 702. In this illustrated embodiment, a total of four thermal dissipation members 712 are present, although this number may be varied if desired. In some embodiments, the thermal dissipation members 712 can have an undulating configuration and thus may act as springs, thereby limiting vibrations and other shocks that could otherwise be transferred from the housing 702 to the structural component 704. A thermally conductive fluid may circulate through the housing 702, if desired.

Figure 8:
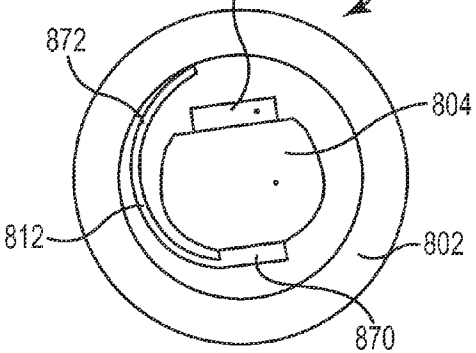
FIG. 8 is a schematic cross-sectional illustration of a portion of a downhole apparatus in accordance with an embodiment of the disclosure.

FIG. 8 is a schematic cross-sectional illustration of a portion of a downhole apparatus 800 that includes a housing 802. A heat producing component 806 is in thermal contact with a structural component 804. A thermal dissipation member 812 extends from the structural component 804. As illustrated, the thermal dissipation member 812 includes a first portion 870 that makes physical (and direct thermal) contact with the structural component 804 and a second portion 872 that extends away from the first portion 870 and towards the housing 802. In some embodiments, at least part of the second portion 872 can make physical contact with the housing 802 for direct thermal transfer/conduction therebetween. In some embodiments, the second portion 872 can be a (curved) beam that may help to dampen shocks/vibrations that may be transferred from the housing 802 to the structural component 804. A thermally conductive fluid may circulate through the housing 802, if desired.

Figure 9:
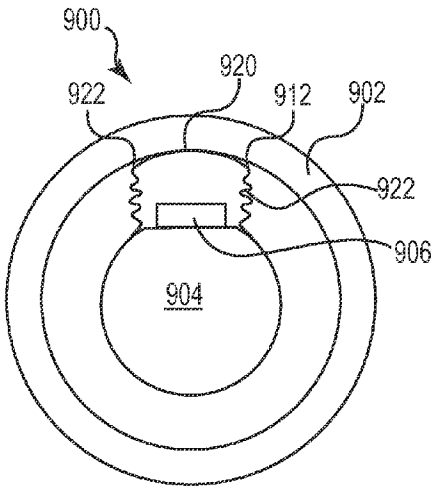
FIG. 9 is a schematic cross-sectional illustration of a portion of a downhole apparatus in accordance with an embodiment of the disclosure.

FIG. 9 is a schematic cross-sectional illustration of a portion of a downhole apparatus 900 that includes a housing 902. A heat producing component 906 is in thermal contact with a structural component 904. A thermal dissipation member 912 extends from the structural component 904 and contacts the housing 902. As illustrated, the thermal dissipation member 912 includes a curved portion 920 that makes substantial physical contact with the housing 902 to provide direct thermal transfer/conduction therebetween as well as spring-like portions 922 (two spring-like portions are used in this embodiment, although other numbers are contemplated) that, in some embodiments, may serve to dampen or absorb vibrations and other shocks that could otherwise be transmitted from the housing 902 to the structural component 906. In some embodiments, the curved portion 920 of the thermal dissipation member 912 may be slightly spaced apart from the housing 902 to further reduce shocks/vibrations. A thermally conductive fluid may circulate through the housing 902, if desired.

Figure 10:
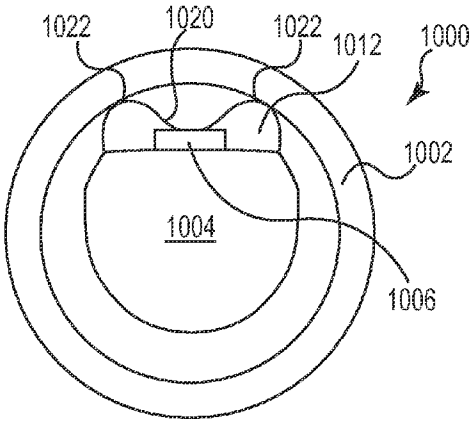
FIG. 10 is a schematic cross-sectional illustration of a portion of a downhole apparatus in accordance with an embodiment of the disclosure.

FIG. 10 is a schematic cross-sectional illustration of a portion of a downhole apparatus 1000 that includes a housing 1002. A heat producing component 1006 is in thermal contact with a structural component 1004. A thermal dissipation member 1012 extends from the structural component 1004 and contacts the housing 1002. As illustrated, the thermal dissipation member 1012 includes a central portion 1020 that makes physical contact with the heat producing component 1006 and two protruding portions 1022 that make physical contact the housing 1002 to provide direct thermal transfer/conduction therebetween. In some embodiments, the central portion 1020 and/or the protruding portions 1022 of the thermal dissipation member 1012 may be slightly spaced apart from the heat producing component 1006 and/or the housing 1002 respectively to limit the vibrations, shocks and the like that may be transmitted from the housing 1002 to the heat producing component 1006 and/or the structural component 1004. A thermally conductive fluid may circulate through the housing 1002, if desired.

Figure 11:
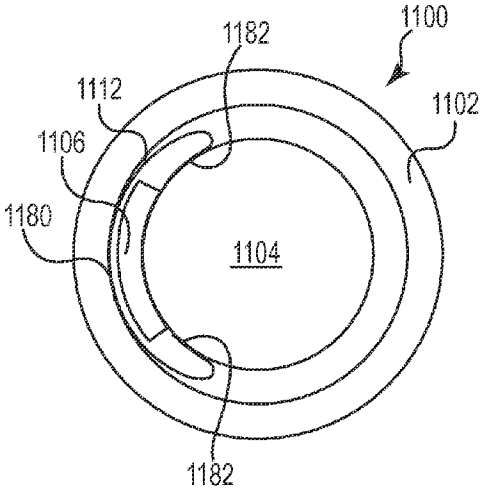
FIG. 11 is a schematic cross-sectional illustration of a portion of a downhole apparatus in accordance with an embodiment of the disclosure.

FIG. 11 is a schematic cross-sectional illustration of a portion of a downhole apparatus 1100 that includes a housing 1102. A heat producing component 1106 is in thermal contact with a structural component 1104. A thermal dissipation member 1112 extends from the structural component 1104 and contacts the housing 1102. As illustrated, the thermal dissipation member 1112 includes a central portion 1180 that makes substantial physical contact with the housing 1102 and thereby provides direct thermal transfer/conduction therebetween as well as attachment portions 1182 (two attachment portions are used in this embodiment, although other numbers are contemplated) that are attached to the structural component 1104 and thus provide direct thermal transfer/conduction therebetween. In some embodiments, the central portion 1180 can be slightly spaced apart from the housing 1102 to reduce the shocks/vibrations that may be transferred from the housing 1102 to the structural component 1104. A thermally conductive fluid may circulate through the housing 1102, if desired.

Figure 12:
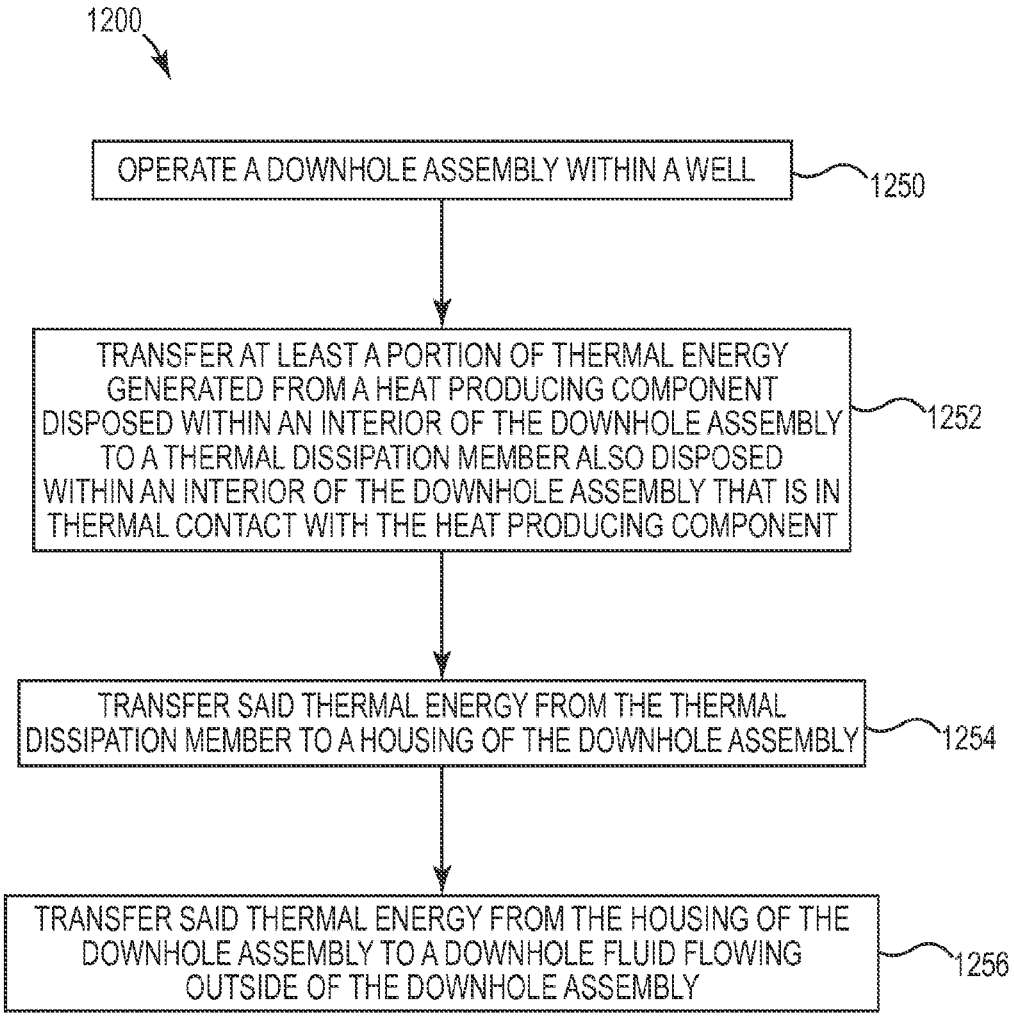
FIG. 12 is a flow diagram illustrating a method in accordance with an embodiment of the disclosure.

FIG. 12 illustrates a thermal dissipation method 1200 that may be carried out, for example, using the downhole apparatus described above in association with FIGS. 2-11. The downhole apparatus (such as downhole apparatus 200, 300, 400, 500, 600, 700, 800, 900, 1000, 1100 respectively shown in FIGS. 2-11) may be operated within a well, as generally referenced at block 1250. As referenced at block 1252, thermal energy produced from one or more heat producing components (such as heat producing components 206, 306, 406, 506, 606, 706, 806, 906, 1006, 1106) that are disposed within an interior of the downhole apparatus is transferred to one or more thermal dissipation members (such as thermal dissipation members 212, 312, 412, 512, 612, 712, 812, 912, 1012, 1112) that are also disposed within the interior of the downhole assembly and in thermal contact with the heat producing components. In some implementations, at least a portion of the thermal energy is transferred to the one or more thermal dissipation members via a structural component (such as structural component 204, 304, 404, 504, 604, 704, 804, 904, 1004, 1104) of the downhole apparatus that is in thermal contact with both the one or more heat producing components and the one or more thermal dissipation members. The thermal energy is then transferred from the one or more thermal dissipation members to a housing of the downhole apparatus, as referenced at block 654. As shown at block 656, the thermal energy is further transferred from the housing of the downhole apparatus to a downhole fluid (such as drilling fluid 26) flowing outside of the downhole apparatus which can then be circulated up to the surface for thermal dissipation/cooling and again circulated downhole for reuse.

Figure 13:
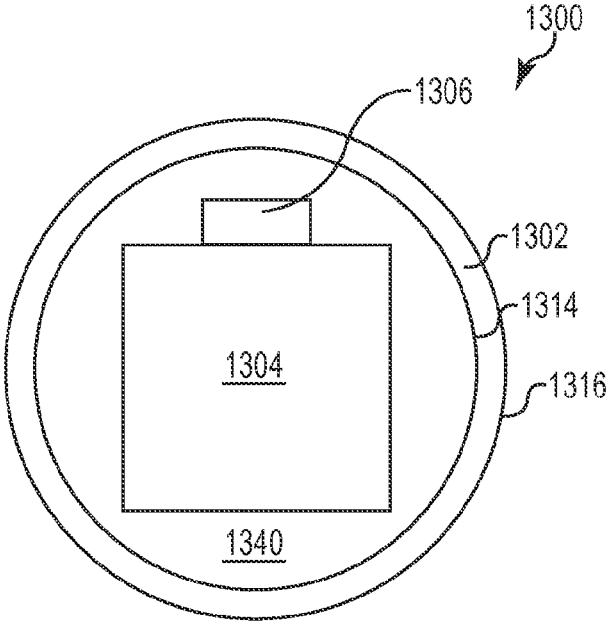
FIG. 13 is a schematic cross-sectional illustration of a portion of a downhole apparatus in accordance with an embodiment of the disclosure.

FIG. 13 is a schematic cross-sectional illustration of a portion of a downhole apparatus 1300 that includes a housing 1302 having an inner surface 1314 and an outer surface 1316 that is adapted to be in contact with a downhole fluid (e.g., drilling fluid 26 of FIG. 1). A structural component 1304 extends through the housing 1302 and may serve as a mounting location for one or more heat producing components 1306. The one or more heat producing components 1306 are in thermal contact with the structural component 1304. The heat producing components 1306 may include packaged electronic components such as the multi-chip modules (MCMs) discussed with respect to the heat producing components 206 shown FIG. 2.

As illustrated in FIG. 13, the inner surface 1314 defines an internal volume 1340. Instead of including one or more thermal dissipation members that are secured to the structural component 1304, this embodiment relies upon a thermally conductive fluid circulating through the internal volume 1340 to carry thermal energy from the heat producing component 1306 and the structural component 1304 to the housing 1302.

Figure 14:
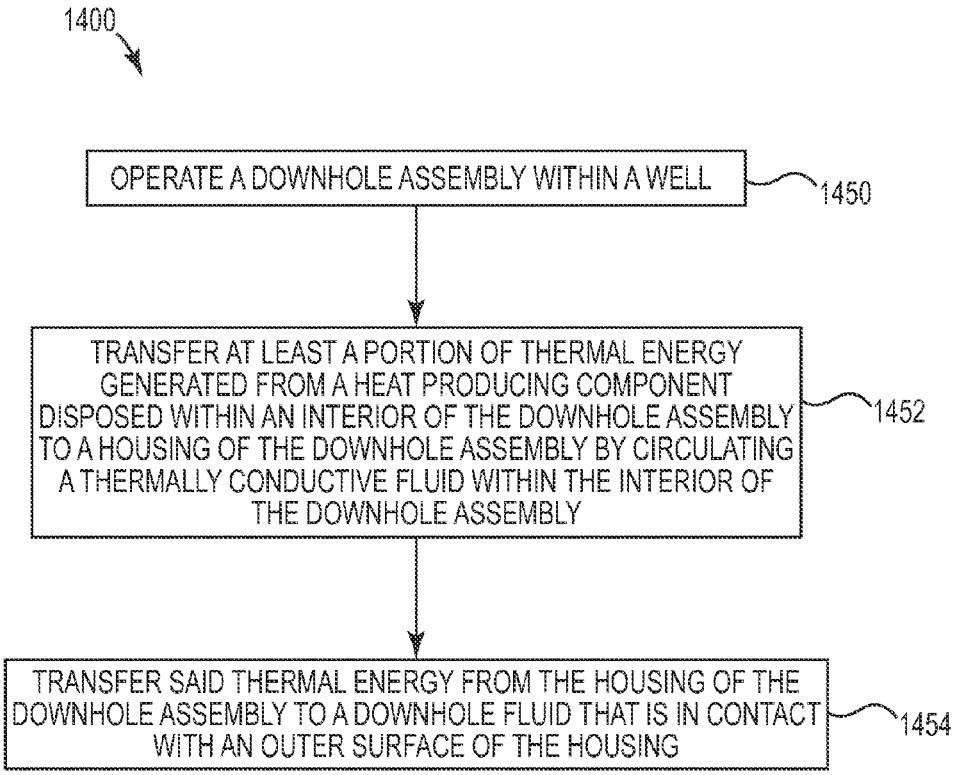
FIG. 14 is a flow diagram illustrating a method in accordance with an embodiment of the disclosure.

FIG. 14 illustrates a thermal dissipation method 1400 that may be carried out, for example, using the downhole apparatus described above in association with FIG. 13. The downhole apparatus (such as downhole apparatus 1300 shown in FIG. 13) may be operated within a well, as generally referenced at block 1450. As referenced at block 1452, thermal energy produced from one or more heat producing components (such as heat producing components 1306) that are disposed within an interior of the downhole apparatus is transferred to an housing (such as housing 1302) of the downhole apparatus by circulating a thermally conductive fluid within the interior of the downhole apparatus. As shown at block 1454, the thermal energy is then transferred from the housing of the downhole apparatus to a downhole fluid (such as drilling fluid 26) that is in contact with an outer surface (such as outer surface 1316) of the housing. The downhole fluid can then be circulated up to the surface for thermal dissipation/cooling and again circulated downhole for reuse.

Various modifications, additions and combinations can be made to the above described embodiments and their various features discussed without departing from the scope of the present disclosure. For example, while the embodiments described above refer to particular features, the scope of the inventive subject matters also includes embodiments having different combinations of features and embodiments that do not include each of the above described features.

We claim:

1. A downhole assembly comprising:

a housing having an inner surface and an outer surface configured to be in contact with a downhole fluid;

a structural component extending through the housing;

one or more heat producing components; and one or more thermal dissipation members extending from the structural component and in thermal contact with the one or more heat producing components and the inner surface of the housing, wherein at least a portion of the one or more thermal dissipation members has an undulating profile that provides multiple contacts between the one or more thermal dissipation members and the inner surface of the housing, such that at least a portion of thermal energy generated from the one or more heat producing components is dissipated through the housing into the downhole fluid by transferring said thermal energy from the one or more heat producing components to the inner surface of the housing via the one or more thermal dissipation members.

2. The downhole assembly of claim 1, wherein the structural component is in thermal contact with the one or more heat producing components and the one or more thermal dissipation members; and wherein at least a portion of said thermal energy is transferred from the one or more heating producing components to the one or more thermal dissipation members via the structural component.

3. The downhole assembly of any of claim 1, wherein the one or more thermal dissipation members extend towards the inner surface of the housing such that a spacing remains between the one or more thermal dissipation members and the inner surface of the housing.

4. The downhole assembly of any of claim 1, wherein at least a portion of the one or more thermal dissipation members has a curved profile that is same as or similar to a curvature of the inner surface of the housing.

5. The downhole assembly of any of claim 1, wherein at least one of the one or more heat producing components or at least one of the one or more thermal dissipation members is secured to the structural component.

6. The downhole assembly of any of claim 1, wherein at least one of the one or more heat producing components is in physical contact with at least one of the one or more thermal dissipation members.

7. The downhole assembly of any of claim 1, wherein at least one of the one or more thermal dissipation members comprises copper, pyrolytic graphite or combinations thereof.

8. The downhole assembly of any of claim 1, wherein at least one of the one or more thermal dissipation members comprises a spring-like or beam-like portion.

9. The downhole assembly of any of claim 1, wherein said downhole assembly is a logging-while-drilling or measurement-while-drilling assembly.

10. A method of dissipating thermal energy within a downhole assembly, the method comprising:

operating the downhole assembly within a well;

transferring at least a portion of thermal energy generated from a heat producing component disposed within an interior of the downhole assembly to a thermal dissipation member that is in thermal contact with the heat producing component, the thermal dissipation member being configured so that at least a portion of the thermal dissipation member having an undulating profile that provides multiple contacts between the thermal dissipation member and the inner surface of the housing;

transferring said thermal energy from the thermal dissipation member to a housing of the downhole assembly that is in thermal contact with the thermal dissipation member; and transferring said thermal energy from housing of the downhole assembly to a downhole fluid that is in contact with an outer surface of the housing.

11. The method of claim 10, wherein at least a portion of said thermal energy is transferred from the heat producing component to the thermal dissipation member via a structural component of the downhole assembly that is in thermal contact with both the heating producing component and the thermal dissipation member.

12. The method of claim 10 or 11, further comprising circulating a thermally conductive fluid within the interior of the downhole assembly.

13. A method of claim 10, comprising:

transferring at least a portion of thermal energy generated from the heat producing component to an inner surface of the housing of the downhole assembly by circulating a thermally conductive fluid within the interior of the downhole.

* * * * *